US005606846A

United States Patent [19]

Raby et al.

[11] Patent Number: 5,606,846

[45] Date of Patent: Mar. 4, 1997

[54] BAG SEALING

[75] Inventors: James M. Raby, Lewiston, N.Y.; Garry R. Coats, Plano, Tex.

[73] Assignee: Moore Business Forms, Inc., Grand Island, N.Y.

[21] Appl. No.: 304,226

[22] Filed: Sep. 12, 1994

[51] Int. Cl.[6] ..... B65B 61/00

[52] U.S. Cl. ..... 53/415; 53/469; 53/416

[58] Field of Search ..... 53/411, 415, 416, 53/469; 383/78, 84, 86, 89; 206/813; 427/207.1, 208; 156/247, 289; 428/40–43; 283/81

[56] References Cited

U.S. PATENT DOCUMENTS

| | | | |
|---|---|---|---|
| Re. 30,958 | 6/1982 | White . | |
| Re. 32,249 | 9/1986 | Esmay . | |
| 2,586,039 | 2/1952 | Heggedal . | |
| 2,845,728 | 8/1958 | Huber . | |
| 3,711,011 | 1/1973 | Kugler . | |
| 3,942,713 | 3/1976 | Olson et al. . | |
| 4,066,167 | 1/1978 | Hanna et al. . | |
| 4,157,410 | 6/1979 | McClintock . | |
| 4,415,087 | 11/1983 | Clayton et al. . | |
| 4,441,613 | 4/1984 | Hain et al. . | |
| 4,543,139 | 9/1985 | Freedman et al. . | |
| 4,554,193 | 11/1985 | Erickson . | |
| 4,599,265 | 7/1986 | Esmay . | |
| 4,739,879 | 4/1988 | Nakamura . | |
| 4,839,206 | 6/1989 | Waldenberger . | |
| 4,844,973 | 7/1989 | Konishi et al. . | |
| 4,851,074 | 7/1989 | Uchida . | |
| 4,860,899 | 8/1989 | McKee | 383/84 |
| 4,902,141 | 2/1990 | Linnewiel . | |
| 4,902,142 | 2/1990 | Lammert et al. . | |
| 4,911,563 | 3/1990 | Ciani . | |
| 4,942,071 | 7/1990 | Frye . | |
| 4,950,517 | 8/1990 | Loggins . | |
| 5,035,518 | 7/1991 | McClintock . | |
| 5,130,185 | 7/1992 | Ness . | |
| 5,135,313 | 8/1992 | Bowman | 383/89 |
| 5,217,307 | 6/1993 | McClintock . | |
| 5,234,735 | 8/1993 | Baker et al. | 283/81 |
| 5,358,281 | 10/1994 | Greig | 283/81 |
| 5,366,087 | 11/1994 | Bane | 206/813 |
| 5,419,591 | 5/1995 | Lambert et al. | 283/81 |
| 5,435,600 | 7/1995 | Griffiths et al. | 283/81 |
| 5,482,753 | 1/1996 | Langan et al. | 428/42 |
| 5,484,168 | 1/1996 | Chigot | 283/81 |
| 5,489,456 | 2/1996 | Instance | 428/43 |

FOREIGN PATENT DOCUMENTS

| | | | |
|---|---|---|---|
| 0517566 | 12/1992 | European Pat. Off. | 383/89 |
| 0579430 | 1/1994 | European Pat. Off. | 428/42 |

*Primary Examiner*—John Sipos
*Assistant Examiner*—Ed Tolan
*Attorney, Agent, or Firm*—Nixon & Vanderhye P.C.

[57] ABSTRACT

A method of packaging physical objects in a container, and a container assembly so formed, advantageously utilize a container-sealer in the general form of a double faced label. The container sealer includes a flexible strip of material comprising a substrate having first and second faces, a permanent pressure sensitive adhesive with removal release liner on the first face, and a repositional adhesive on the second face. One or more physical objects are placed in the container through an openable/closeable portion of the container, at a first location the repositional adhesive of the container-sealer is placed into contact with a surface of the container and with a packing order indicating the desired contents of the container, and at a second location the container-sealer is removed from contact with the container and the packing order and the desired contents of the container are compared with the actual contents. Then the release liner is removed from the permanent adhesive and the permanent adhesive is brought into contact with the container over the openable/closeable portion to hold it closed, while the repositional adhesive faces away from the container. An invoice/receipt relating to the desired physical objects in the container is then brought into contact with the repositional adhesive. The container is typically a bag or a carton, and the container-sealer typically has a length of about 4–6 inches and a width of about 1.5–3 inches, is dispensed from a roll, and may have a perforation line which overlays the closure of the container to facilitate opening.

20 Claims, 2 Drawing Sheets

Fig. 1
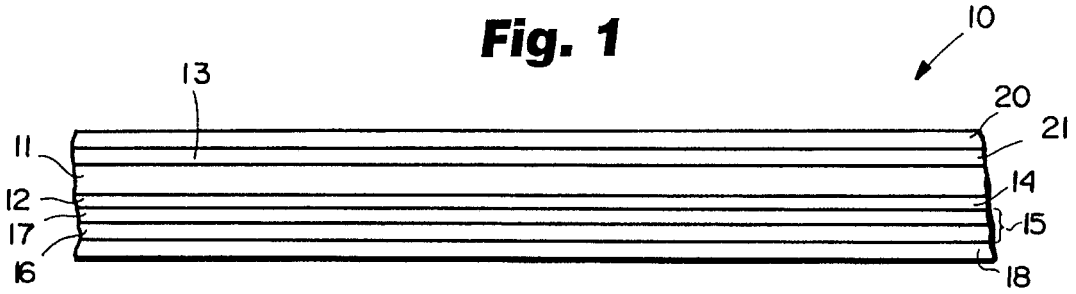
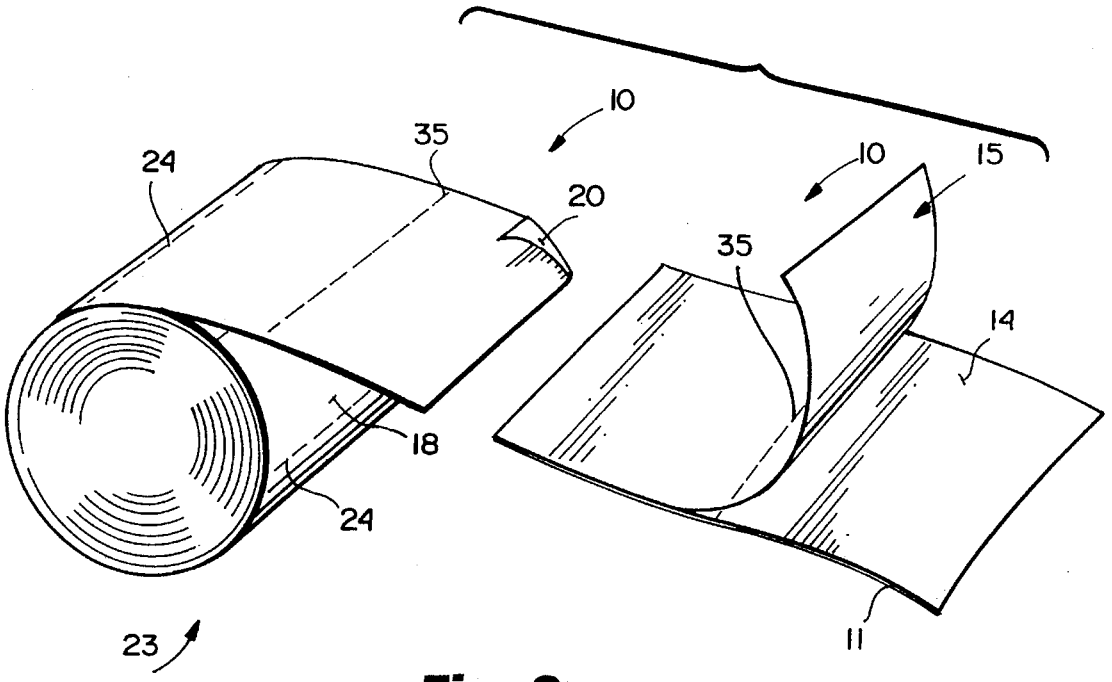
Fig. 2

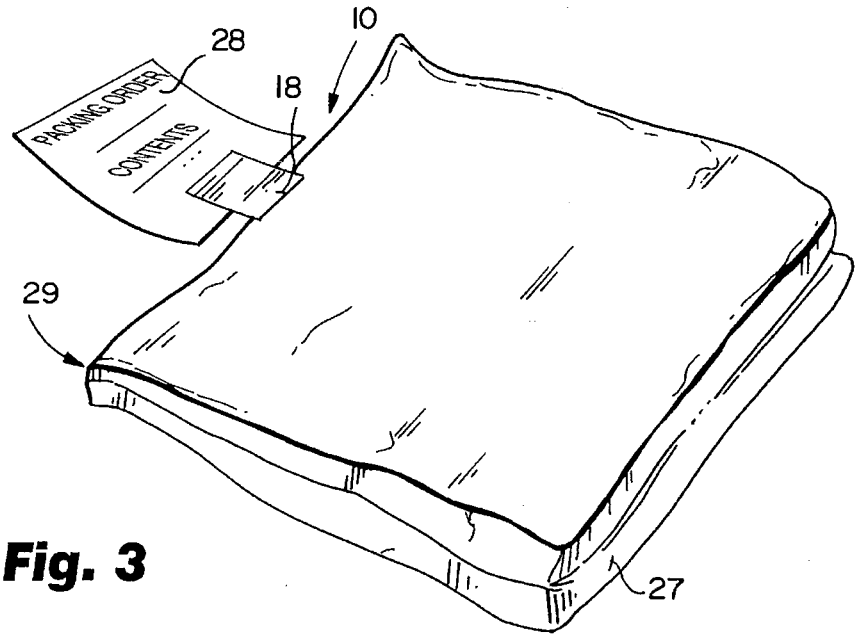
Fig. 3
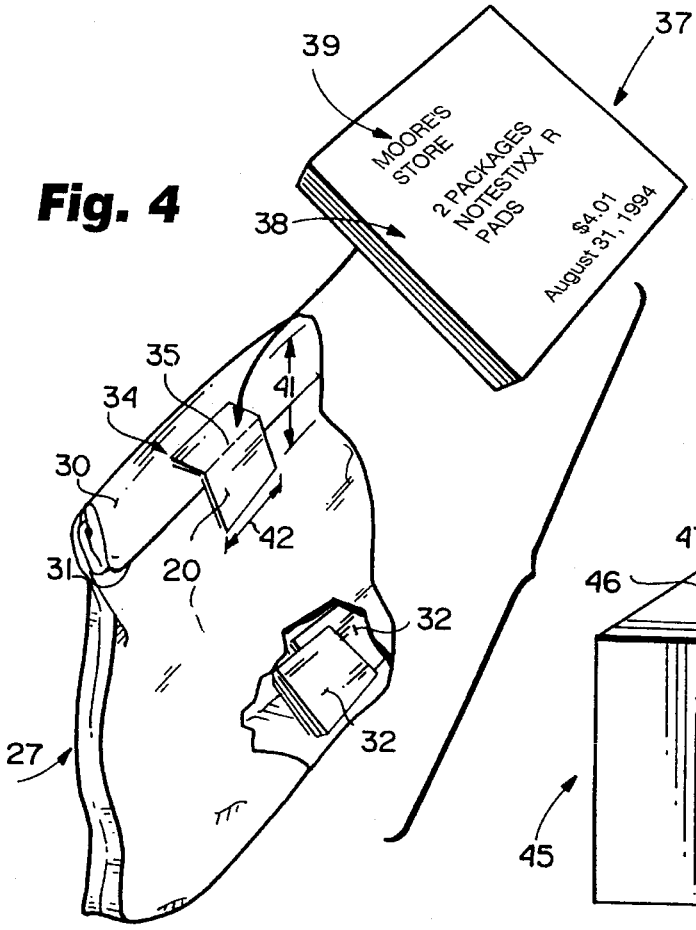
Fig. 4
Fig. 5
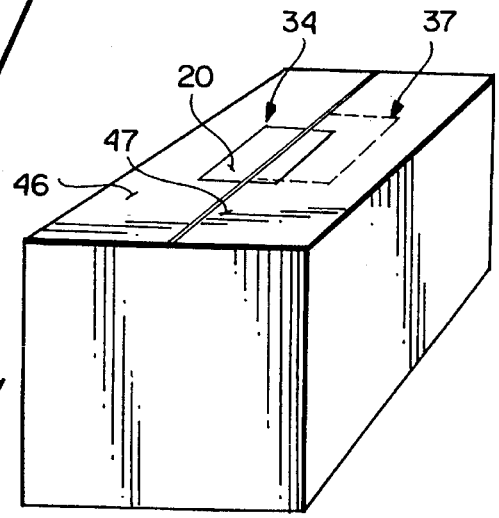

BAG SEALING

BACKGROUND AND SUMMARY OF THE INVENTION

The invention relates to a method of packaging physical objects in a container having an openable/closeable portion, and a container assembly. The invention is particularly advantageous when utilized in association with merchandise/catalog retailers who fill orders, and seal packages, in a particular manner.

Traditionally when a merchandise/catalog retailer receives orders for merchandise from customers, the orders are entered into a computer data base. A packing order and an invoice are typically issued. The packing order and invoice may be the same document, or different documents. In any event the packing order is viewed while a bag, carton, or other container is filled with physical objects corresponding to the packing order, and then the container is placed on a conveyor belt or deposited within a bin, along with the packing order. The packing order can easily be blown off the conveyor, or become covered by merchandise which is not properly deposited in the container, ultimately requiring extra work to locate the packing order at the point where the contents of the container will be shown to the customer, or just prior to shipping.

Also, at the point where the contents of the bag are filled with the physical objects (merchandise) the bag is then folded over and stapled shut through the invoice/receipt. The stapling is highly unadvantageous, however, since the removal of the staple is difficult for the ultimate consumers, the invoice (or part of it) is often destroyed when the staple is removed and the bag is opened unless so great care is taken, the merchandise within the bag can snag on partially removed staples when the merchandise is being removed from the bag, the workers'hands and clothing may catch on the staples as the bags are being handled, or the customers'hands and clothing can also be adversely impacted by the bag. Bag sealing personnel have complained about the ergonomics of the tedious mechanical stapling action, and in fact Workman's Compensation claims have even been filed as a result.

According to the present invention the above mentioned problems are alleviated by utilizing a container-sealer—which has the general construction of a dual faced label—that not only is highly advantageous compared to staples for closing the bags, but can be used to releasably tie a packing order to the container as the container moves from one area to the final, closure, area, thereby eliminating all of the problems discussed above.

According to one aspect of the present invention, a method of packaging physical objects in a container having an openable/closeable portion is provided. The method utilizes a container-sealer including a flexible strip of material comprising a substrate having first and second faces, a permanent pressure sensitive adhesive with removable release liner on the first face, and repositional adhesive on the second face. The method comprises the steps of substantially sequentially: (a) Placing one or more desired physical objects in the container through the openable/closeable portion thereof. (b) Removing the release liner from the permanent pressure sensitive adhesive on the first face of the container-sealer substrate. (c) Applying the container-sealer to the container by bringing the permanent pressure sensitive adhesive into contact therewith to hold the openable/closeable portion of the container closed, with the repositional adhesive on the second face of the container-sealer substrate facing away from the container. And, (d) bringing a flexible sheet having indicia thereon into contact with the repositional adhesive, to be held thereby.

The method of step (d) is typically practiced to bring an invoice/receipt relating to the desired physical objects in the container into contact with the repositional adhesive of the container-sealer. Since the invoice only contacts repositional adhesive it may be readily removed from the container and remain completely readable and intact. The container-sealer, being of a flexible substrate, does not have the problems of application or harming hands or clothing, of the prior art system. The container-sealer typically has a length of about 4–6 inches and a width of about 1.5–3 inches.

Most often the container is a bag, e.g. of paper or plastic, and the openable/closeable portion is a mouth of the bag. In that case step (c) is practiced by folding over the open mouth of the bag to close it, defining a closing line, and then placing permanent adhesive from the container-sealer on opposite sides of the closing line. Typically the closer-sealer has a line of weakness, in which case step (c) is further practiced to place the line of weakness over and in substantial alignment with the closing line, to facilitate bag opening.

Alternatively the container may be a carton (or a wide variety of other containers), having a pair of closing flaps, in which case step (c) is practiced by putting permanent adhesive of the container-sealer on each of the closing flaps.

The method also typically comprises the further steps, between steps (a) and (b), of: (e) At a first location placing the repositional adhesive of the container-sealer into contact with a surface of the container and with a packing order indicating the desired contents of the container. (f) At a second location, removing the container-sealer from contact with the container and the packing order. And, (g) at the second location comparing the indication of desired contents of the container with the actual contents of the container.

Typically the closer/sealer comprises a web in roll form, and there are the further steps of dispensing each individual closer-sealer from the roll, and separating it from the roll web, prior to step (e).

According to another aspect of the present invention a container assembly is provided comprising the following elements: A container having an openable/closeable portion. At least one physical object within the container. A container-sealer comprising a flexible strip of material including a substrate having first and second faces, a permanent pressure sensitive adhesive with removable release liner on the first face, and a repositional adhesive on the second face. And, a flexible sheet, having indicia thereon related to the contents of the container, in contact with the repositional adhesive, and held thereby.

The flexible sheet, container details, and dimensions of the container-sealer, are preferably as described above with respect to the method aspect of the invention.

The container-sealer according to the present invention may be made from a wide variety of materials, may be easily run on a label press, and may or may not have any printing thereon. In any event it, and the particular use thereof and container assembly produced thereby as described above, are highly advantageous compared to the prior art.

BRIEF DESCRIPTION OF THE DRAWINGS

FIG. 1 is a side view, greatly exaggerated in size for clarity of illustration, of an exemplary container-sealer utilized according to the present invention;

FIG. 2 is a top perspective view illustrating the container-sealer of FIG. 1 being dispensed from a web in roll form;

FIG. 3 illustrates one of the container-sealers of FIGS. 1 and 2 utilized to hold a packing order in association with a container, for example during transport on a conveyor;

FIG. 4 is a top perspective view, with a portion of the container cut away to illustrate the interior thereof, of an exemplary container assembly according to the present invention; and FIG. 5 is a view like that of FIG. 4 for a second embodiment of a container assembly according to the invention.

DETAILED DESCRIPTION OF THE DRAWINGS

An exemplary container-sealer for use according to the present invention is shown generally by reference numeral 10 in FIGS. 1 through 3. The desired elements forming the container-sealer 10 are illustrated in FIG. 1, greatly exaggerated in size for clarity of illustration.

The basic part of the container-sealer 10 comprises a substrate 11 having first and second faces 12, 13. The substrate 11 is preferably conventional label stock, e.g. 20–24 lb. (i.e. lbs. per 500 sheet 11×17 inch ream) paper, or plastic, or a like conventional substrate material. On the first face 12 is a permanent pressure sensitive adhesive 14. The particular adhesive is not significant, but any suitable conventional permanent pressure sensitive adhesive can be used (such as National Starch Nacor™ 38-4549). Covering the permanent adhesive 14 is a release liner 15 of conventional construction, comprising a liner substrate 16, typically of paper, with a silicone or like release material coating 17, the coating 17 in contact with the adhesive 14. Also, in order to facilitate transport of the closer-liners in roll form and so that only a single release liner need be provided, a release coating 18 is also provided on the face of the liner stock 16 opposite the silicone coating 17. A suitable release coating 18 is QUILON C® available from DuPont Chemical Company of Wilmington, Del.

On the second face 13 of the substrate 11 is a repositional adhesive 20, such as CLEANTAC® adhesive available from Moore Business Forms, Inc. of Lake Forest, Ill. In order to ensure that the adhesive 20 properly adheres to the face 13, a conventional tie coat 21 may be provided.

The adhesive layers 14, 20 may be full coated layers, or pattern coated, depending upon the particular use of the container-sealer 10, the environment, or other factors.

The container-sealers 10 are typically constructed in web form. Preferably they are run on a label press, such as a Webtron 1600 press, die cut, matrix-stripped, and slit. Then they are taken up into rolls, an exemplary roll form being illustrated by reference numeral 23 in FIG. 2. Also lines of weakness, such as perforations, as indicated at 24 in FIG. 2, may be provided between individual container-sealers 10 in the roll form 23 of the web. Alternatively the perforation lines 24 may be eliminated and instead a dispenser may be used for semi-automatically or manually dispensing the container-sealers 10. The dispenser would have a cut-off mechanism, such as a blade, and if semi-automatic then typically registration marks would be provided instead of the perforation lines 24, which would be sensed by the dispenser to effect cut-off of the container-sealers with the desired length (e.g. about five inches).

As seen in FIG. 2, the repositional adhesive 20 engages the QUILON C® release coat 18 when in the roll form 23. FIG. 2 also shows the release liner 15 being removed from the permanent pressure sensitive adhesive 14 of an individual container-sealer 10.

FIG. 3 shows one use of a container-sealer 10 during a method of packaging physical objects in a container, in this case the bag 27, which may be of paper, plastic, or other suitable conventional material. During filling of an order received by a vendor, such as a merchandise/catalog retailer, at a first location the packing order 28 is utilized to locate objects (merchandise) corresponding to the order, and the objects are placed in the bag 27. Then the bag 27 and packing order 28 are transported to a second, different location, typically on a conveyor belt, or within a bin. According to the present invention the packing order 28 is held in association with the bag 27, while harming neither, by utilizing the container-sealer 10. This is accomplished by pressing the repositional adhesive 20 into contact with both an exterior or interior surface of the bag 27 and the packing order 28, so that they will stay together during subsequent transport, as illustrated in FIG. 3, yet they both can be readily detached from the repositional adhesive 20 of the container-sealer 10 once they reach the second location.

At the second location, once the packing order 28 and the bag 27 are disconnected from the repositional adhesive 20, the merchandise (physical objects) within the bag 27 are compared to the list on the packing order 28. Assuming that all physical objects that should be there are present within the bag 27, the open mouth 29 of the bag is then folded over, providing the folded over portion 30 illustrated in FIG. 4, and defining the closing line 31 so that the physical objects 32 (see FIG. 4) are within the bag 27. Then the release liner 15 is removed from contact with the permanent adhesive 14, and the permanent adhesive 14 is placed in contact with the bag 27, so that it is in contact with the portions thereof on opposite sides of the closing line 31, as illustrated in FIG. 4. The permanent adhesive 14 will securely hold the bag 27 closed. In this form the container-sealer, which no longer has the release liner 15 (or its additional release coating 18) is illustrated generally by reference numeral 34.

In order to facilitate opening of the bag 27, the container-sealer 10, 34 may be constructed with a line of weakness, such as a perforation line 35 (see FIGS. 2 and 4) extending parallel to the main perforation lines 24 thereof, i.e. across the width of the container-sealers 10, 34. The perforation line 35 may only be in the substrate 11 and its associated coatings 14, 20, 21, i.e. not in the release liner 15. In any event, when a container-sealer 34 with a perforation line 35 is utilized, the perforation line 35 is placed over and substantially in alignment with the closing line 31 of the bag 27.

After the bag 27 is closed, it is in the position illustrated in FIG. 4, a flexible sheet 37 having indicia 38, 39 thereon (see FIG. 4) may be brought into contact with the repositional adhesive 20 which faces outwardly from the container 27. The indicia 38 may be indicia indicating the store supplying the merchandise 32, or any other desired indicia (including a shipping address or the like), while the indicia 39 typically indicates the contents of the bag 27, and often also the price. That is typically the sheet 37 comprises a conventional paper invoice/receipt. As earlier indicated the invoice/receipt 37 and the packing order 28 may be one in the same document, although more typically they will be different documents; or they can be part of the same basic document, transported with the bag 27 as illustrated in FIG. 3, and then separated at the time of bag closure (FIG. 4). The invoice/receipt 37 remains intact since no staples or other mechanical fasteners pierce it, and it can be readily removed from the repositional adhesive 20 and retained by the ultimate consumer in a file.

While the dimensions of the container-sealer 10, 34 are not particularly critical, they must of course be sufficient for the ordinary use to which the container-sealer 10, 34 is put. It is particularly advantageous that the container-sealer 10, 34 have a length 41 (see FIG. 4) of about four to six inches, and a width 42 of about 1.5–3 inches. The perforation line 35, if present, typically bisects the length 41.

While the invention has been described with respect to a bag 27 as the container, a wide variety of other types of containers may also be utilized. For example FIG. 5 illustrates a container-sealer 34 in association with a cardboard carton 45 having a pair of closing flaps 46, 47. The permanent adhesive 14 from the container-sealer 34 is placed into contact with both of the flaps 46, 47, sealing carton 45 as illustrated in FIG. 5. Other sealing mechanisms, such as sealing tape, may also be utilized if necessary or desirable. An invoice/receipt 37 is shown in dotted line in. FIG. 5, overlying the container-sealer 34 and in contact with the repositional adhesive 20 thereof.

It will thus be seen that according to the present invention an advantageous method of packaging physical objects in a container, and an advantageous container assembly, have been provided. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent methods and assemblies.

What is claimed Is:

1. A method of packaging physical objects in a container having an openable/closeable portion, utilizing a container-sealer including a flexible strip of material comprising a substrate having first and second faces, a permanent pressure sensitive adhesive with removable release liner on the first face, and a repositional adhesive on the second face, comprising the steps of substantially sequentially:

(a) placing one or more desired physical objects in the container through the openable/closeable portion thereof;

(b) removing the release liner from the permanent pressure sensitive adhesive on the first face of the container-sealer substrate;

(c) applying the container-sealer to the container by bringing the permanent pressure sensitive adhesive into contact therewith to hold the openable/closeable portion of the container closed, with the repositional adhesive on the second face of the container-sealer substrate facing away from the container; and (d) bringing a flexible sheet having indicia thereon into contact with the repositional adhesive, to be held thereby.

2. A method as recited in claim 1 comprising the further steps, between steps (a) and (b), of: (e) at a first location placing the repositional adhesive of the container-sealer into contact with a surface of the container and with a packing order indicating the desired contents of the container; (f) at a second location, removing the container-sealer from contact with the container and the packing order; and (g) at the second location comparing the indication of a desired contents of the container as indicated by the packing order with the actual contents of the container.

3. A method as recited in claim 2 wherein step (d) is practiced to bring an invoice/receipt relating to the desired physical objects in the container into contact with the repositional adhesive of the container-sealer.

4. A method as recited in claim 3 wherein the container is a bag, and wherein the openable/closeable portion is a mouth of the bag; and wherein step (c) is practiced by folding over the open mouth of the bag to close it, defining a closing line, and then placing permanent adhesive from the container-sealer on opposite sides of the closing line.

5. A method as recited in claim 4 wherein the closer-sealer has a line of weakness formed therein, and wherein step (c) is further practiced to place the line of weakness over and in substantial alignment with the closing line, to facilitate bag opening.

6. A method as recited in claim 3 wherein the closer-sealer comprises a web in roll form, and comprising the further steps of dispensing each individual closer-sealer from the roll, and separating it from the roll web, prior to step (e).

7. A method as recited in claim 1 wherein the closer-sealer comprises a web in roll form, and comprising the further steps of (e) dispensing each individual closer-sealer from the roll, and (f) separating each individual closer-sealer from the roll web, prior to step (b).

8. A method as recited in claim 7 wherein steps (e) and (f) are practiced to dispense and separate as each container-sealer a container-sealer with a length of between about 4–6 inches and a width of between about 1.5–3 inches.

9. A method as recited in claim 1 wherein step (d) is practiced to bring an invoice/receipt relating to the desired objects in the container into contact with the repositional adhesive of the container-sealer.

10. A method as recited in claim 1 wherein the container is a bag, and wherein the openable/closeable portion is a mouth of the bag; and wherein step (c) is practiced by folding over the open mouth of the bag to close it, defining a closing line, and then placing permanent adhesive from the container-sealer on both sides of the closing line.

11. A method as recited in claim 10 wherein the closer-sealer has a line of weakness formed therein, and wherein step (c) is further practiced to place the line of weakness over and in substantial alignment with the closing line, to facilitate bag opening.

12. A method as recited in claim 1 wherein the container is a carton, having a pair of closing flaps, and wherein step (c) is practiced by putting permanent adhesive of the container-sealer on each of the closing flaps.

13. A method as recited in claim 2 wherein the closer-sealer comprises a web in roll form, and comprising the further steps of dispensing each individual closer-sealer from the roll, and separating it from the roll web, prior to step (e).

14. A method as recited as recited in claim 13 wherein said dispensing and separating steps are practiced to dispense and separate as each container-sealer a container-sealer with a length of between 4–6 inches and a width of between about 1.5–3 inches.

15. A method as recited in claim 2 wherein the container is a carton, having a pair of closing flaps, and wherein step (c) is further practiced by putting permanent adhesive of the container-sealer on each of the closing flaps.

16. A method as recited in claim 3 wherein the container is a carton, having a pair of closing flaps, and wherein step (c) is further practiced by putting permanent adhesive of the container-sealer on each of the closing flaps.

17. A method as recited in claim 12 wherein the closing flaps define a closing line; and wherein the openable/closeable portion is at said closing line; and wherein the closer/sealer has a line of weakness formed therein; and wherein step (c) is further practiced to place the line of weakness over and in substantial alignment with the closing line, to facilitate carton opening.

18. A method as recited in claim 15 wherein the closing flaps define a closing line; and wherein the openable/closeable portion is at said closing line; and wherein the closer-sealer has a line of weakness formed therein; and wherein step (c) is further practiced to place the line of weakness over and in substantial alignment with the closing line, to facilitate carton opening.

19. A method as recited in claim 1 wherein the container-sealer has a length of between about 4–6 inches and a width of between about 1.5–3 inches.

20. A method as recited in claim 19 wherein step (d) is practiced to bring an invoice/receipt relating to the desired physical objects in the container and to contact with the repositional adhesive of the container-sealer.

* * * * *